United States Patent [19]

Skinner

[11] 4,061,412

[45] Dec. 6, 1977

[54] TERMINAL FOR A RESISTANCE HEATING ELEMENT

[75] Inventor: Charles A. Skinner, Laurel, Md.

[73] Assignee: Electro-Therm, Inc., Laurel, Md.

[21] Appl. No.: 636,475

[22] Filed: Dec. 15, 1975

[51] Int. Cl.[2] ..... H01R 11/26

[52] U.S. Cl. ..... 339/263 R; 339/32 R; 339/256 SP; 219/541

[58] Field of Search ..... 339/32, 33, 256, 258, 339/263, 266, 277; 219/451, 541

[56] References Cited

U.S. PATENT DOCUMENTS

| | | | |
|---|---|---|---|
| 2,942,232 | 6/1960 | Knocke | 339/263 R |
| 3,139,318 | 6/1964 | Binder et al. | 339/258 S |
| 3,617,703 | 11/1971 | Ewart, Jr. | 219/541 |
| 3,812,321 | 5/1974 | Skinner | 339/217 S |

FOREIGN PATENT DOCUMENTS

| | | | |
|---|---|---|---|
| 793,562 | 4/1958 | United Kingdom | 339/258 S |

*Primary Examiner*—Joseph H. McGlynn
*Attorney, Agent, or Firm*—Henry W. Collins; Eugene M. Cummings; Richard D. Kinney

[57] ABSTRACT

An improved terminal for a sheathed resistance heating element includes a body portion, and a tab portion folded over and connected to the body portion by a neck portion of reduced width. A first aperture for receiving a large size threaded fastener is provided on the body portion, and a second aperture axially-aligned with the first aperture is provided on the tab portion for receiving a smaller sized threaded fastener. The tab portion is dimensioned for sliding engagement with a standard female quick-connect type connector.

5 Claims, 8 Drawing Figures

TERMINAL FOR A RESISTANCE HEATING ELEMENT

BACKGROUND OF THE INVENTION

The present invention is directed generally to electric heating element assemblies, and more particularly to an improved terminal for connecting a sheathed resistance heating element to a source of electrical energy.

Surface-type electric heating elements, which are widely used in electric ranges, hot plates and similar appliances, usually comprise an elongated tubular sheath containing a resistance wire which is electrically insulated from and held in position within the sheath by a concentric layer of compacted refractory material. The heating element is formed into a flat winding and electrical connections are established with the resistance wire at the ends of the element by means of terminal pins fitted into the ends.

To supply electrical power to the heating element the terminal pins are connected to a source of electrical energy. This may be accomplished by either plugging the terminal pins into a socket for contact with spring contacts carrying electrical current, or by connecting the terminal pins to lead wires by means of individual screw connections enclosed within a terminal block, such as that described and claimed in the co-pending application of the present applicant, Ser. No. 624,697, filed Oct. 22, 1975, now U.S. Pat. No. 4,029,896, and assigned to the present assignee.

In either case, to avoid the necessity of bending or deforming the terminal pins with the attendant risk of damage to the heating element, and to permit connection to the widest possible variety of electrical sources, the terminal pins are preferably spot-welded or otherwise attached to terminals to which the electrical connections are actually made. While such terminals may have various constructions, one construction which has proven particularly successful is that described and claimed in U.S. Pat. No. 3,812,321 of the present applicant, which is also assigned to the present assignee. In this patent a blade-type terminal is disclosed for connecting the terminal pins of the heater assembly to either a plug-in type socket, or to lead wires by means of screw-type connections. The present invention is directed to an improved construction for this blade-type terminal which renders the terminal adaptable to a greater number of applications.

SUMMARY OF THE INVENTION

The invention is directed to a universal blade-type terminal for use in conjunction with a sheathed heating element having a central resistance conductor. The terminal comprises a generally flat body portion fastened to the central resistance conductor at one end and having an aperture thereon formed to receive a first threaded fastener, and a generally flat tab portion joined to the distal end of the body portion by a neck portion of reduced width, the tab portion being folded back over the body portion and having an aperture thereon axially aligned with the first aperture and formed to receive a second threaded fastener having a different sized thread than the first fastener, whereby the terminal is adaptable to receiving at least two different sized fasteners.

The invention is further directed to a heating element assembly comprising a sheathed heating element having a central resistance conductor and a universal blade-type terminal having a generally flat body portion fastened to the central resistance conductor at one end and having an aperture thereon formed to receive a first threaded fastener, and a generally flat tab portion joined to the distal end of the body portion by a neck portion of reduced width, the tab portion being folded back over the body portion and having an aperture thereon axially aligned with the first aperture and formed to receive a second threaded fastener having a different sized thread than the first fastener, whereby the terminal is adaptable to receiving at least two different sized fasteners.

The invention is further directed to a universal blade-type terminal for use in conjunction with a sheathed heating element having a central resistance conductor. The terminal comprises a generally flat body portion fastened to the central conductor of the heating element at one end and having an aperture thereon, and a generally flat tab portion joined to the distal end of the body portion by a neck portion of reduced width, the tab portion being folded back over the body portion and having an aperture thereon axially aligned with the first aperture and being dimensioned for sliding engagement with a female quick-disconnect-type connector.

The invention is further directed to a heating element assembly comprising a sheathed heating element having a central resistance conductor, and a universal blade-type terminal having a generally flat body portion fastened to the central conductor of the heating element at one end and having an aperture thereon, and a generally flat tab portion joined to the distal end of the body portion by a neck portion of reduced width, the tab portion being folded back over the body portion and having an aperture thereon axially aligned with the first aperture and being dimensioned for sliding engagement with a female quick-connect-type connector.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

DESCRIPTION OF THE PREFERRED EMBODIMENT

Figure 1:
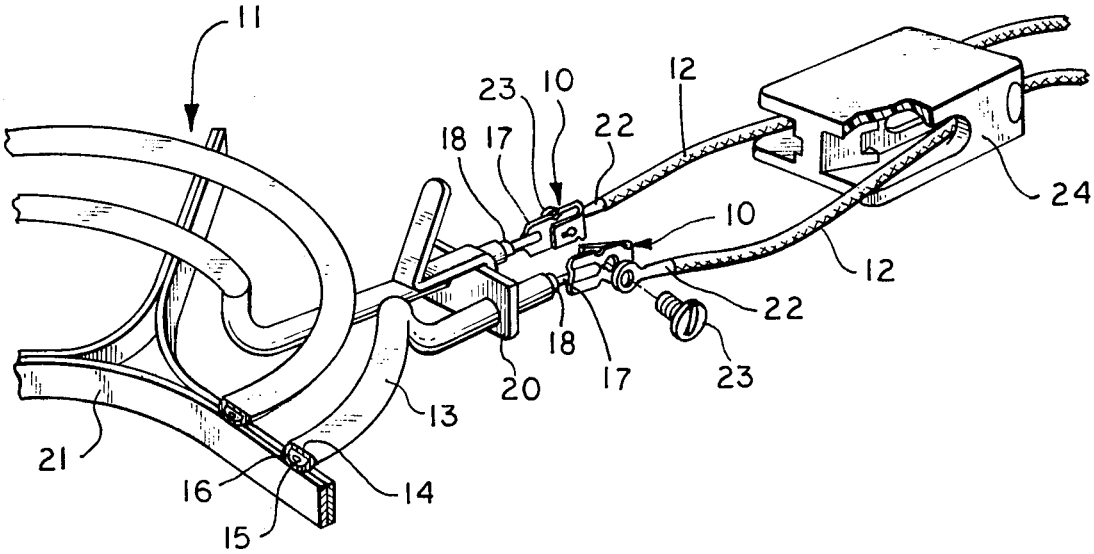
FIG. 1 is a perspective view showing terminals constructed in accordance with the present invention in conjunction with a surface-type heating element assembly and an insulating terminal block prior to installation.
Figure 2:
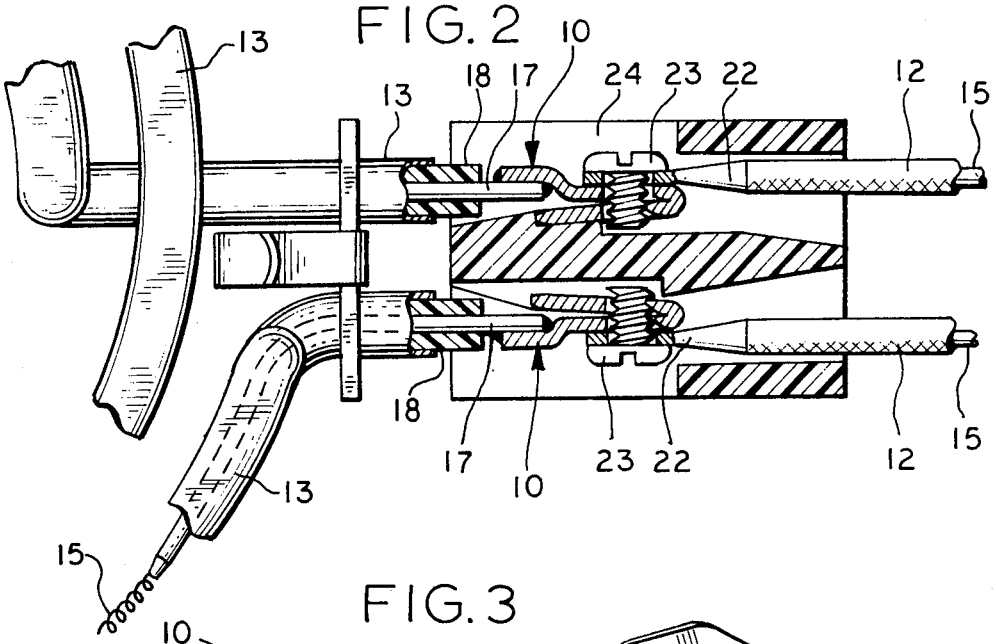
FIG. 2 is an enlarged plan view, partially in section, showing the components of FIG. 1 in an installed condition.
Figure 3:
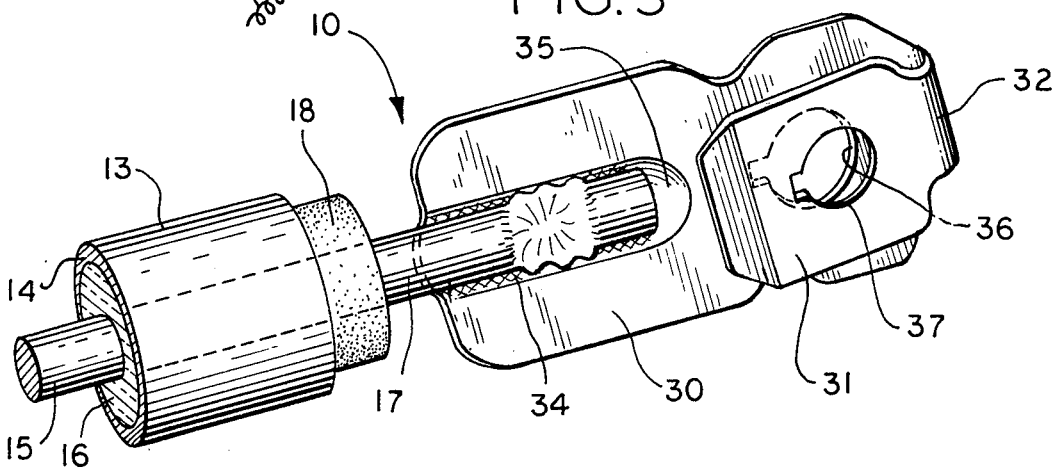
FIG. 3 is an enlarged perspective view of the terminal spot-welded to the terminal pin of a sheathed resistance heating element.

Referring to the figures, and particularly to FIGS. 1–3, a terminal 10 constructed in accordance with the invention is shown in conjunction with a conventional surface-type resistance heating element assembly 11 and a pair of electric conductors in the form of flexible lead wires. Assembly 11, which may be entirely conventional in design and construction, includes a conventional resistance heating element 13 having an elongated tubular metal sheath 14 which contains an axially disposed resistance wire 15 which is electrically insulated from and held in position within the sheath by a concentric sleeve 16 of compacted refractory material. In accordance with conventional practice, the element is arranged in the form of a flat winding with its end portions disposed below and extending laterally from the flat winding. Opposite ends of the resistance wire are connected to terminal pins 17, each of which has a portion disposed within the sheath and a portion extending beyond the ends of the sheath. Insulating bushings 18 may be positioned over the terminal pins within the ends of the sheath.

Usually, a metal strip 20 is connected across the terminal portions of the sheath, as shown in FIG. 1, to hold these portions in a definite spaced relationship. Ordinarily, only one end of the sheath is bonded to the strip to provide for expansion and contraction of the sheath without lateral deformation of the flat winding. An additional support bracket 21 may be provided beneath the coil to maintain the coil in horizontal alignment during use.

Electrical power is supplied to the resistance heating element by means of lead wires 12 which terminate in closed-loop lugs 22. In use these lugs are maintained in tight contact against the surface of terminals 10 by means of threaded fasteners in the form of machine screws 23 threaded into the terminals. An insulated terminal block 24, which may be like that described and claimed in the afore-identified U.S. Pat. No. 3,812,321 of the present applicant, or alternatively like that described and claimed in the co-pending application of the present applicant, Ser. No. 624,697 filed Oct. 22, 1975, and assigned to the present assignee, is preferably fitted over the completed connections to provide electrical and mechanical protection.

Figure 4:
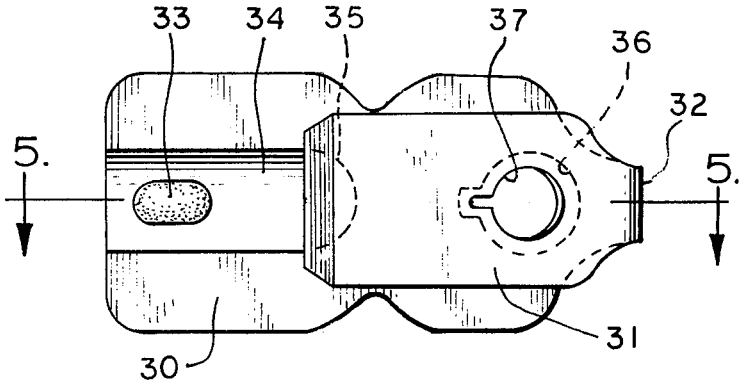
FIG. 4 is a type elevational view of the blade-type terminal of the invention.
Figure 5:
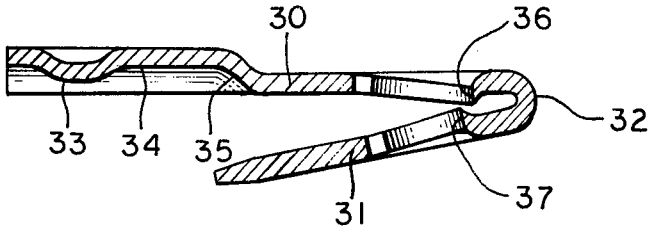
FIG. 5 is a cross-sectional view taken along lines 5—5 of FIG. 4.

Referring to FIGS. 3–5, terminal 10 includes a body portion 30 and a folded-back tab portion 31 which is connected to the body portion by a neck portion 32 of reduced width. Tab portion 31 is folded back toward body portion 30 at the neck portion so that the tab and body portions reside substantially one over the other, as most clearly shown in FIG. 5. The terminal may be stamped from a thin sheet of resilient nickel plated sheet metal, and may be spot-welded or otherwise fastened to the projecting portion of terminal pin 17 as shown in FIG. 3. For this purpose a weld projection 33 (FIG. 4) may be provided within a channel 34 on the surface of the terminal. A shoulder or abutment 35 defines the channel end and serves as a stop for the terminal pin 15 to assure proper orientation of the components prior to the spot weld operation. Tab portion 31 is dimensioned to extend over this shoulder to prevent burrs which may exist on the end of the cold pins from making contact with adjacent receptacle contacts when the terminal is used in a plug-in application.

To adapt terminal 10 for connection to lead wires by means of a screw-type connection, the end of body portion 30 and tab portion 31 are provided with apertures 36 and 37, respectively. These apertures are stamped or formed so as to have a circumferential edge for receiving a threaded fastener in threaded engagement, and are positioned such that when the body and tab portions are folded, as shown in FIGS. 4 and 5, the apertures lie along a common center line as shown in FIGS. 1 and 2.

Figure 6:
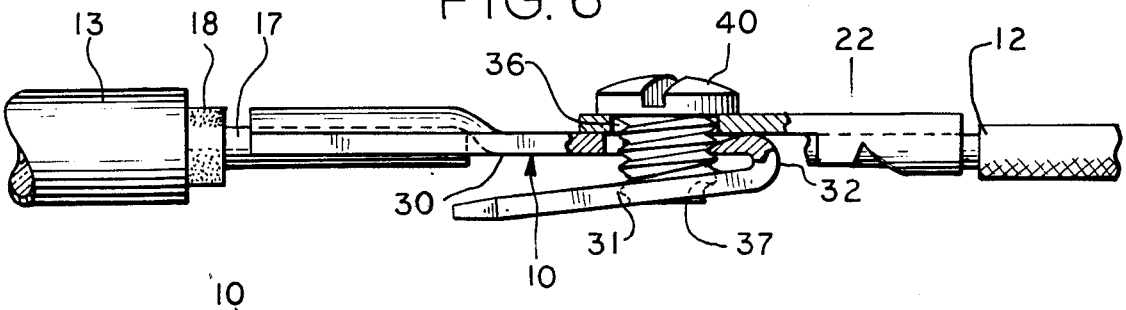
FIG. 6 is an enlarged side elevational view, partially in cross section, showing the terminal utilized in conjunction with a larger sized threaded fastener.

In accordance with the invention, aperture 36 is dimensioned to receive in threaded engagement a threaded fastener or machine screw of larger size than aperture 37. As shown in FIG. 6, this allows terminal 10 to accommodate fastening means in the form of two different sized screws. In FIGS. 1 and 2 a screw 23 of smaller diameter or size is utilized. This screw passes freely through aperture 36 and into threaded engagement with aperture 37. When this screw is tightened it draws against tab portion 31 so as to bring terminal 22 into contact with the surface of terminal 10. In FIG. 6 a screw 40 of relatively larger diameter or size is threaded into aperture 36, drawing against body portion 30 when tightened to bring terminal 22 into contact with the surface of terminal 10. Thus, screws of at least two different sizes are accommodated by terminal 10. In practice, aperture 36 may be dimensioned to receive 10–32 sized machine screws, and aperture 37 may be dimensioned to receive 8–32 sized machine screws, and tab portions 31 may be broken off at its neck when using the larger 10–32 size screws.

Figure 7:
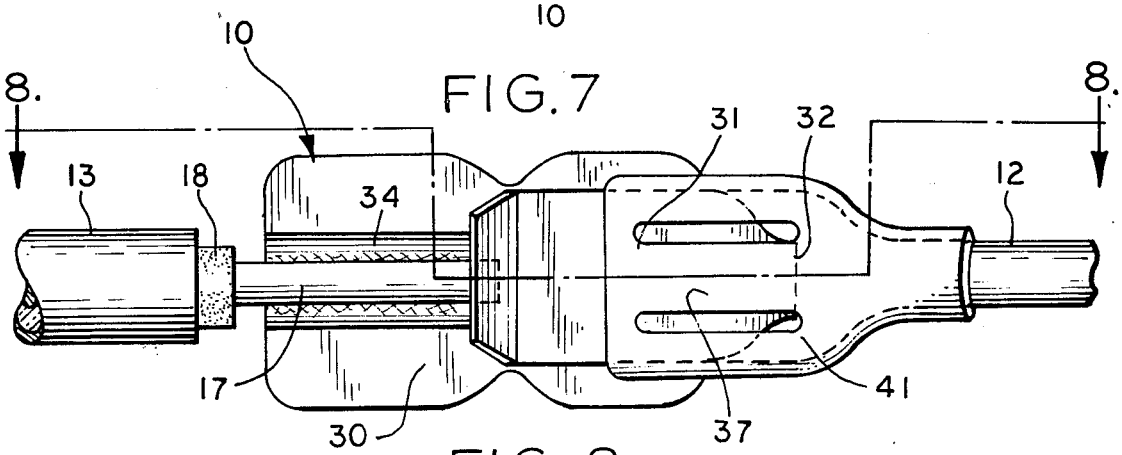
FIG. 7 is an enlarged top plan view showing the terminal utilized in conjunction with a female quick-disconnect-type fastener.
Figure 8:
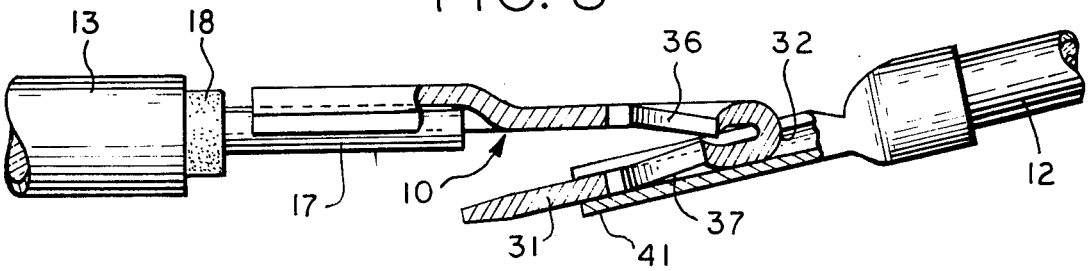
FIG. 8 is a cross-sectional view taken along line 8—8 of FIG. 7.

It is also possible to utilize terminal 10 in conjunction with a female quick-connect or spade lug receiving type connector 41. As shown in FIGS. 7 and 8, connector 41 is slidably received over the margins of the tab portion 31 of the terminal, the tab portion being dimensioned to correspond to a standard male spade connector to facilitate such sliding engagement. By reason of the neck portion 32 of terminal 10 being narrower than the tab portion, connector 41 is free to slide onto the tab portion at the point at which it folds back. As a result, an electrically and mechanically secure electrical connection is obtained without the use of machine screws or other fastening hardware. In practice, the terminal may be stamped from sheet metal having a thickness of 0.031 inch, and the body portion may have a width of 0.031 inch, the tab portion a width of 0.25 inch, and the neck portion a thickness of 0.031 inch for compatibility with widely used one-fourth inch spade-type connectors.

By reason of its capability of accommodating two different sizes of machine screws, which allows it to be used in connection with different sizes of lead wires and associated connecting lugs, and its capability of engaging female quick-connect type lugs, terminal 10 is particularly useful for replacement market use where a wide variety of type of electrical connections are encountered and the necessity of manufacturing and stocking heating assemblies fitted with a large number of different types of terminals is to be avoided.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A universal blade-type terminal for use in conjunction with a sheathed heating element having a central conductor, said terminal comprising: a generally flat, elongate body portion for being fastened to the central conductor of the sheathed heating element at one end thereof and having a first aperture formed therein and sized to receive a first threaded fastener of one diameter; and a generally flat tab portion connected to the other end of said body portion by an arcuate neck portion of reduced width such that said tab portion extends under said body portion, said tab portion having a second aperture formed therein which is axially aligned with said first aperture and sized to receive a second threaded fastener having a different diameter than said first fastener, whereby said terminal is adaptable to receive one of at least two fasteners of different diameters.

2. A blade-type terminal as defined in claim 1 wherein said first aperture is formed to received a larger diameter fastener than said second aperture.

3. A blade-type terminal as defined in claim 1 wherein said first aperture is formed to receive a 10–32 machine screw and said second aperture is formed to receive an 8–32 machine screw.

4. A heating element assembly comprising, in combination: a sheathed heating element having a central conductor; and a universal blade-type terminal having a generally flat, elongate body portion fastened to the central conductor of the sheathed heating element at one end thereof and having a first aperture formed therein and sized to receive a first threaded fastener of one diameter; and a generally flat tab portion connected to the other end of said body portion by an arcuate neck portion of reduced width such that said tab portion extends under said body portion, said tab portion having a second aperture formed therein which is axially aligned with said first aperture and sized to receive a second threaded fastener having a different diameter than said first fastener, whereby said terminal is adaptable to receive one of at least two fasteners of different diameters.

5. A heating element assembly as defined in claim 4 wherein said first aperture is formed to receive a larger diameter fastener than said second aperture.

* * * * *